US008864600B2

(12) United States Patent
Dickie

(10) Patent No.: US 8,864,600 B2
(45) Date of Patent: Oct. 21, 2014

(54) GOLF CHIP SHOT TRAINING AID AND METHOD OF USING THE SAME

(71) Applicant: Brunton Innovations Inc., King (CA)

(72) Inventor: Robert G. Dickie, King (CA)

(73) Assignee: Brunton Innovations Inc., King City, Ontario (CA)

( * ) Notice: Subject to any disclaimer, the term of this patent is extended or adjusted under 35 U.S.C. 154(b) by 0 days.

(21) Appl. No.: 14/042,925

(22) Filed: Oct. 1, 2013

(65) Prior Publication Data

US 2014/0100051 A1 Apr. 10, 2014

Related U.S. Application Data

(60) Provisional application No. 61/711,779, filed on Oct. 10, 2012.

(51) Int. Cl.
*A63B 69/36* (2006.01)
*A63B 69/00* (2006.01)

(52) U.S. Cl.
CPC ..... *A63B 69/36* (2013.01); *A63B 69/0057* (2013.01)
USPC ..... 473/227

(58) Field of Classification Search
CPC ..... A63B 69/005; A63B 69/00597
USPC ..... 473/201, 206, 207, 212, 213, 226, 227, 473/276, 409
See application file for complete search history.

(56) References Cited

U.S. PATENT DOCUMENTS

| | | | | |
|---|---|---|---|---|
| 2,273,416 | A * | 2/1942 | Norwood | 473/206 |
| 4,944,516 | A * | 7/1990 | Bickler | 473/227 |
| 5,203,568 | A * | 4/1993 | Vasquez | 473/212 |
| 5,427,376 | A * | 6/1995 | Cummings et al. | 473/201 |
| 5,470,073 | A * | 11/1995 | Vasquez | 473/206 |
| 6,251,025 | B1 * | 6/2001 | Brock et al. | 473/227 |
| 7,708,648 | B2 * | 5/2010 | Brunton et al. | 473/206 |

* cited by examiner

*Primary Examiner* — Nini Legesse
(74) *Attorney, Agent, or Firm* — Sand & Sebolt

(57) ABSTRACT

A golf training aid including a generally C-shaped base which snap-fits around the grip of a golf club. A single arm angles downwardly and forwardly away from a top end of the base. A contoured support is provided at the end of the arm which contacts the golfer's wrist and this support substantially prevents the golfer's wrist from breaking, i.e., bending, during the playing of a shot, particularly a chip shot. The arm is adjustable in length and is movable between retracted and extended positions to enable the golfer to customize the training aid to suit his or her body. The training aid assists in keeping the golfer's shoulders and arms in the correct orientation relative to each other to more effectively and consistently play chips shots.

26 Claims, 10 Drawing Sheets

GOLF CHIP SHOT TRAINING AID AND METHOD OF USING THE SAME

CROSS-REFERENCE TO RELATED APPLICATIONS

This application claims the benefit of U.S. Provisional Patent Application Ser. No. 61/711,779, filed Oct. 10, 2012, the entire specification of which is incorporated herein by reference.

BACKGROUND OF THE INVENTION

1. Technical Field

This invention relates generally to golfing equipment. More particularly, this invention relates to training aids used with golf clubs. Specifically, this invention is directed to a training aid and a method of using the same which includes a C-shaped base which snap-fits around the grip of a golf club, and includes a single arm angling downwardly and forwardly away from a top end of the base; and further includes a contoured support pad at the end of the arm which contacts the golfer's trailing forearm and substantially prevents the wrists from breaking during the playing of a shot.

2. Background Information

When a golf ball is a few feet off the green and the golfer wants to get the ball up out of the long grass and going straight for the hole, and he or she has to take a shot that is generally 10 to 15' in distance, then that shot is called a chip shot. It is a very tough shot to learn as it requires a high-angled full swing of a club such as an 8 or 9 iron. On every other type of shot where full swing clubs are used from drivers to wedges, the golfer must break his or her wrists during the shot. Breaking is a term used to describe the golfer bending their wrists during the shot. A chip shot, on the other hand, is played like a putter. So, for the average golfer not to break their wrists, i.e., for them to not bend their wrists when playing this shot, is going against all the muscle memory of that golfer. Golf instructors claim around 99% of amateur golfers tend to break their wrists when playing chip shots.

In order to play a chip shot successfully, the golfer must assume the correct posture and maintain their arm position through the stroke to the end without bending their wrists. In fact the shoulders, arms and club are ideally locked in a Y-type of configuration throughout the stroke. Additionally, the club should be almost directly aligned with the leading arm.

According to www.Free-golf-lessons.com in order to play a chip shot successfully the shot is played like a putting stroke except the motion should last a little longer. The golfer should adopt a posture in which their arms form a triangle with their shoulders as they swing the club rearwardly and through to when they finish the stroke, the golfer should attempt to maintain this triangular shape. According to the website, the golfer needs to keep their left wrist flat. The site states that "This is the part of the stroke where it becomes tempting to hit the shot with your hands and not your whole body. If you do your left wrist will break down and bend so that the club head gets ahead of your hands. This leads to very poor contact. Keep your left wrist flat throughout the shot and your club will never pass your hands." According to the website one of the most important things for a golfer to remember is to ensure that their left wrist is flat at impact as this will ensure that the left wrist does not bend on impact of the club with the ball. The wrist has to stay flat through to the end of the stroke. A way to ensure that the golfer holds the correct posture, the site suggests that the golfer holds their finishing posture until the ball has stopped rolling.

U.S. Pat. No. 5,203,568 (Vasquez) discloses a training aid for helping to train a golfer's muscle memory to play a chip shot without allowing their wrists to break. The device includes an L-shaped support member which has a first leg which has to be held by the golfer's hands against the grip and a second leg which rests on the top end of the grip. If the golfer lets go of the device it will drop away from the grip. The device includes one or two links which are each secured to the top surface of the second leg of the support member by a coupler. The coupler is fixedly engaged with the top surface of the second leg and the link extends outwardly therefrom in a generally horizontal orientation. The link extending outwardly to the golfer's arm extending upwardly from the lower hand is substantially aligned with the centerline of the support member. That link is also disposed generally at right angles to the first leg of the support member. When two links are provided on the training aid, those links extend outwardly from the top surface of the support member and in opposite directions from each other. The first link engages the golfer's left arm and the second link engages the golfer's second arm. Both links extend substantially horizontally outwardly from the top wall of the second leg.

BRIEF SUMMARY

In one aspect, the invention may provide a golf training aid comprising a C-shaped base which snap-fits around the grip of a golf club is disclosed. A single arm angles downwardly and forwardly away from a top end of the base. A contoured support is provided at the end of the arm which contacts the golfer's wrist and this support substantially prevents the golfer's wrist from breaking, i.e., bending, during the playing of a shot, particularly a chip shot. The arm is adjustable in length and is movable between retracted and extended positions to enable the golfer to customize the training aid to suit his or her body. The training aid assists in keeping the golfer's shoulders and arms in the correct orientation relative to each other to more effectively and consistently play chips shots, In another aspect, the invention may provide a method of practicing golfing chip shots includes the steps of:

- positioning a chip-shot training aid on the grip of a golf club;
- aligning an indicator on the aid with the heel of the club;
- positioning the lower hand on the training aid;
- holding the club with the lower hand;
- placing the upper hand on the training aid and grip;
- releasing the grip with the lower hand; and
- adjusting a support arm extending from the training aid to position a support pad thereon against the golfer's wrist extending from their upper hand;
- repositioning the lower hand on the training aid and grip; and
- playing the chip shot.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1:
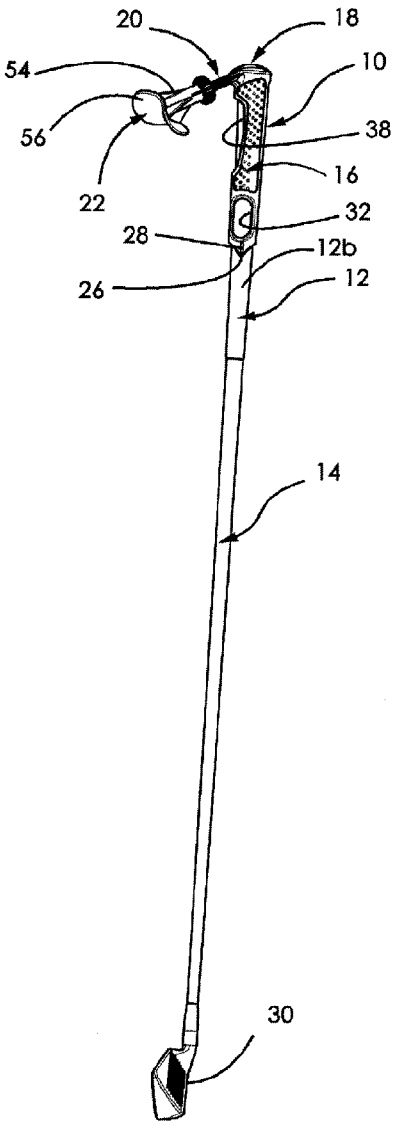
FIG. 1 is a front elevational view of a golf club upon which is engaged a training aid in accordance with an aspect of the present invention.
Figure 2:
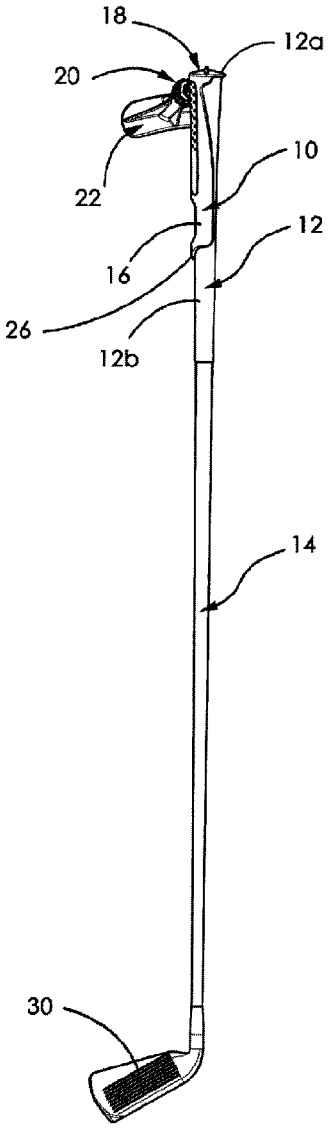
FIG. 2 is a right side elevational view of the golf club and the training aid of FIG. 1.

FIGS. 1 and 2 show a training aid in accordance with an aspect of the present invention, generally indicated at 10. Training aid 10 is configured to engage a grip 12 of a golf club 14.

FIGS. 1-7 show training aid 10 in greater detail. Training aid 10 comprises a base 16 which is configured to engage grip 12, a head 18 which comprises the top end of base 16 and is configured to engage a top end 12*a* (FIG. 2) of grip 12, an adjustable arm 20, and a support 22. It will be understood that training aid 10 is illustrated for use by a right-handed golfer and a training aid for a left-handed golfer would be a mirror image of the device shown herein.

Figure 3:
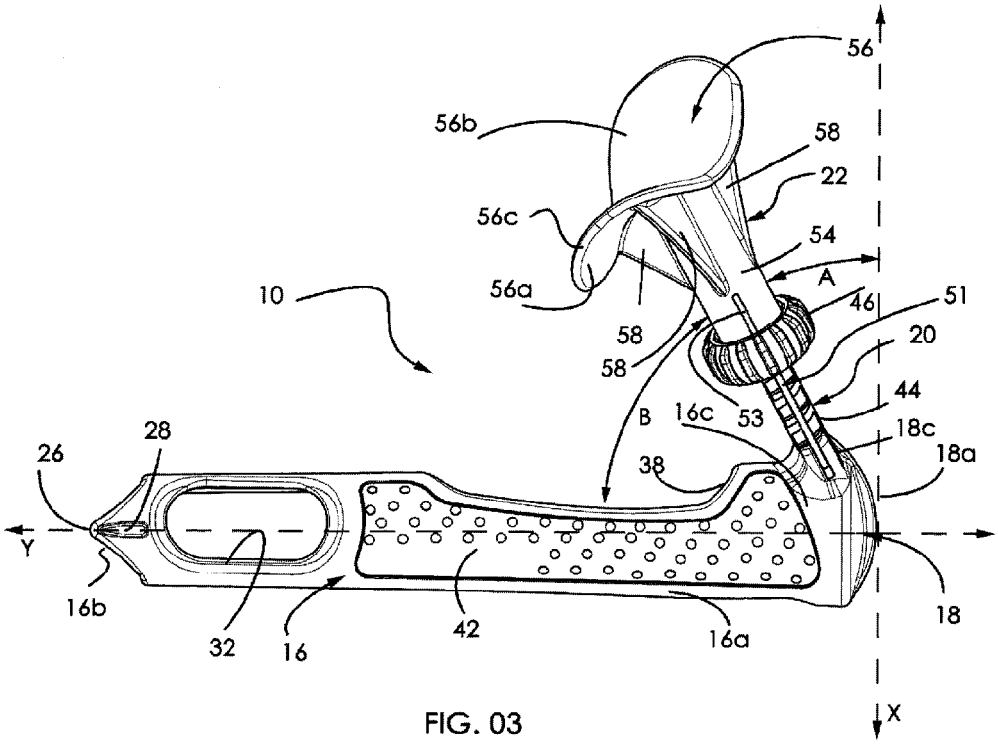
FIG. 3 is a front elevational view of the training aid in accordance with an aspect of the present invention.
Figure 4:
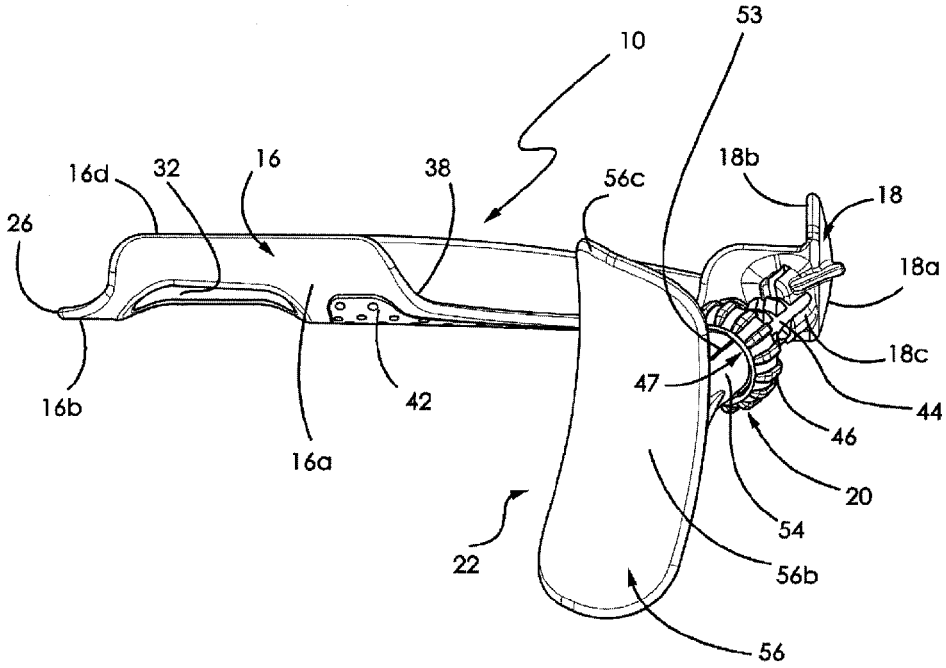
FIG. 4 is a left side view thereof.
Figure 5:
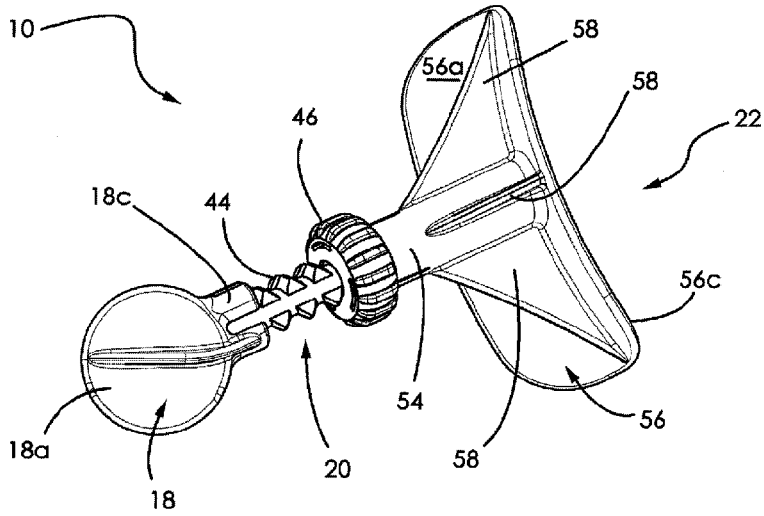
FIG. 5 is a top view thereof.
Figure 8:
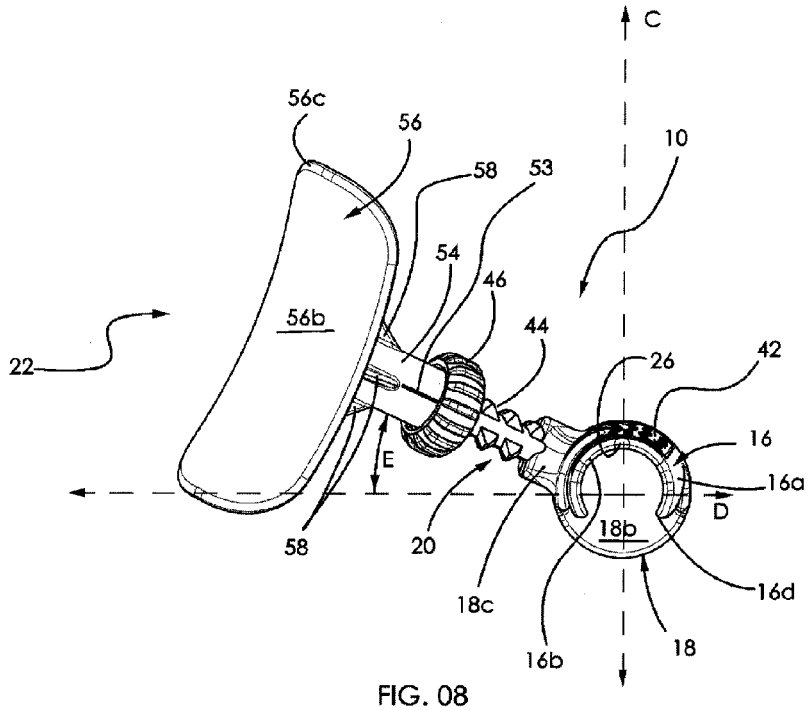
FIG. 8 is a bottom view thereof.

In accordance with another aspect of the present invention, base 16 is an elongate member comprising a generally C-shaped wall 16*a* (as seen in FIG. 8) which has a first end 16*b*, a second end 16*c* and *a* peripheral edge 16*d*. Base 16 has a longitudinal axis "Y" which extends between first and second ends 16*b*, 16*c* thereof. The longitudinal axis "Y" is disposed generally at right angles to first and second ends 16*b*, 16*c*. (FIG. 3 shows longitudinal axis "Y" and a lateral axis "X" which is disposed at right angles relative to longitudinal axis "Y".) Wall 16*a* is configured to be complementary to at least a portion of the radial exterior wall 12*b* of grip 12. When training aid 10 is engaged with grip 12, wall 16*a* snap-fits around grip 12 and is retained thereon partially by spring tension because of the cross-section shape of wall 16*a*, partially by friction, and partially because head 18 of base is in abutting contact with top end 12*a* of grip 12.

First end 16*b* of base 16 is generally V-shaped and terminates in an apex 26. First end 16*b* includes an indicator 28 which is aligned with apex 26 and is parallel to longitudinal axis "Y". Indicator 28 may take any suitable form. Indicator 28 comprises an aperture which is disposed generally parallel to longitudinal axis "Y" of base 16. It will be understood that indicator 28 may alternatively be a marking such as a colored line that extends for a distance along wall 16*a* and in alignment with apex 26. When training aid 10 is engaged with grip 12 of club 14, the apex 26 and indicator 28 are utilized by the golfer to correctly position aid 10 on club 14. In particular, apex 26 and indicator 28 are aligned with the heel 30 of club 14, as shown in FIG. 1.

Second end 16*c* of base 16 is integral with head 18. An aperture 32 is defined in wall 16*a* a distance inwardly from apex 26 and aligned with apex 26 and indicator 28. Aperture 32 is disposed generally parallel to longitudinal axis "Y". Aperture 32 constitutes one of the placement members on base 16 which indicates to the golfer where he or she should place one or more of their digits in order to correctly hold club 14. Aperture 32 is located such that when the golfer places his or her upper hand 34 (FIG. 13) around training aid 10 and grip 12, their thumb 36 will be seated at least partially within aperture 32 and thus will contact a portion of the exterior surface 12*a* of grip 12. Thus, aperture 32 serves to show the golfer where to position their upper hand 34. It will be understood that the advantage of aperture 32 is that the golfer's thumb will engage grip 12 and this aids in ensuring base 16 will not rotate on grip 12. It will be understood however, that any other suitable placement members may be utilized instead of aperture 32. Aperture 32 may, for instance, be replaced with a depression or with ridges which aid in the golfer to position their digits.

Wall 16*a* further defines a recess 38 in the peripheral edge 16*d* thereof. Recess 38 is another of the placement members on base 16. Recess 38 is located along that portion of peripheral edge 16*d* opposite support 22. Recess 38 originates a short distance inwardly from second end 16*c* of base 16 and extends to slightly beyond half of the length of base 16 as measured between first and second ends 16*b*, 16*c* thereof. Recess 38 is situated such that when the golfer grips training aid 10 and grip 12 with their upper hand 34 and places their thumb 36 in aperture 32, the golfers fingers 40 (FIG. 13) will directly contact exterior surface 12*a* of grip 12 in recess 38.

Base 16 is provided with a textured pad 42 which extends substantially from second end 16*c* of base 16 to proximate aperture 32. Pad 42 is generally aligned with aperture 32 and is disposed generally parallel to longitudinal axis "Y". Pad 42 preferably does not extend circumferentially all of the way around wall 16*a* to the peripheral edge 16*d*. Pad 42 preferably comprises a rubberized material that is adhered to wall 16*a* and aids in the golfer gripping training aid 10 with their upper hand 34. When the golfer holds training aid 10 and grip 12 in their upper hand, at least a portion of the golfers palm (not shown) will engage pad 42. This contact will help in ensuring that the golfer's hand 34 does not rotate around grip 12 during the play of a stroke.

Figure 6:
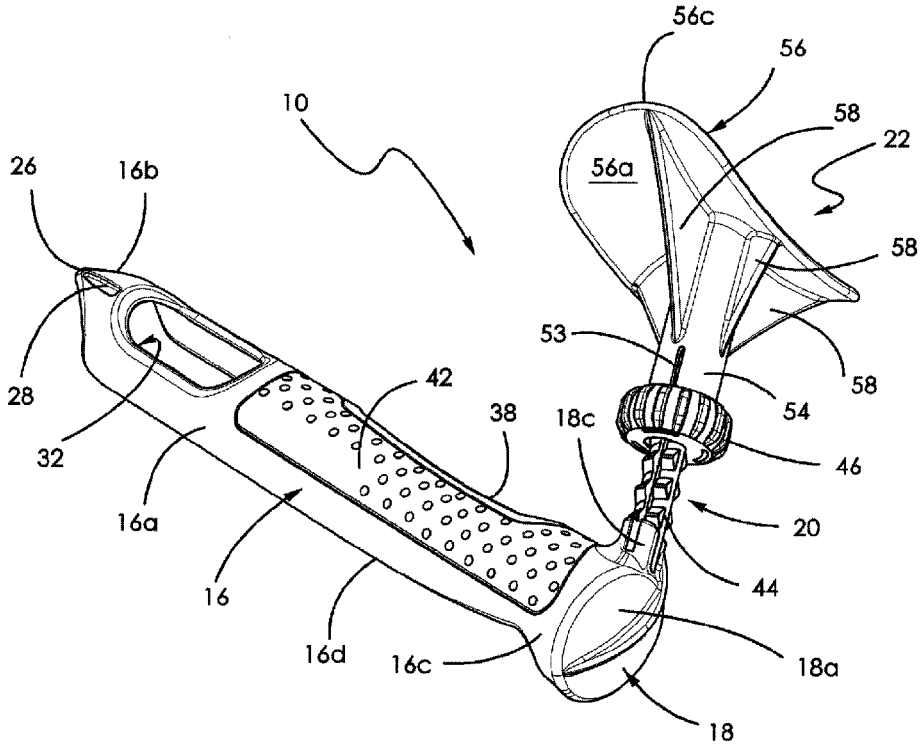
FIG. 6 is a top perspective view thereof.
Figure 7:
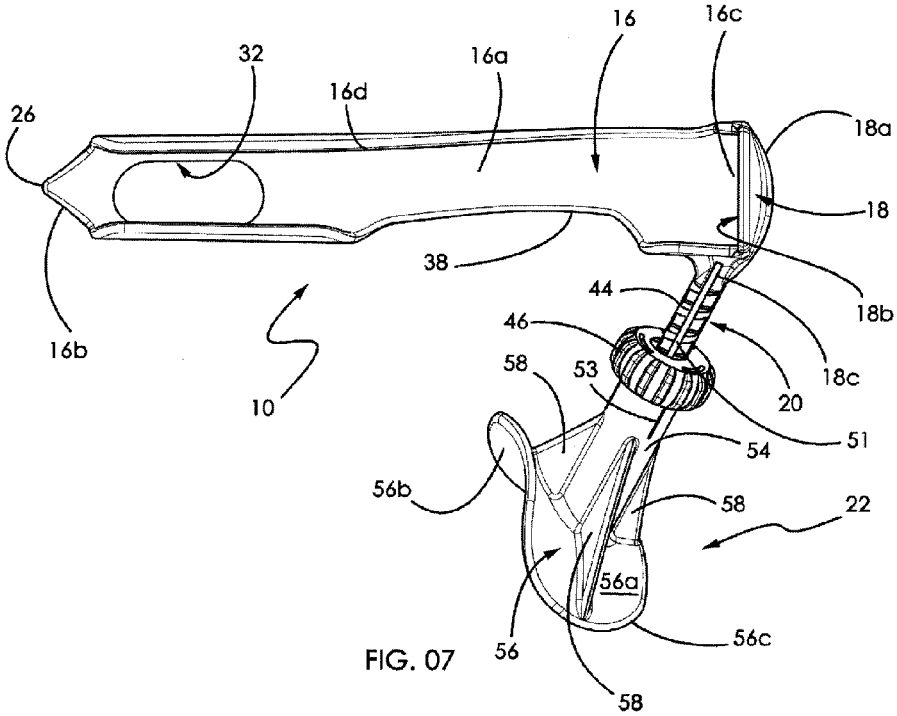
FIG. 7 is rear view thereof.

As indicated above, head 18 extends outwardly from second end 16*c* of base 16 and is integrally formed therewith. Head 18 has an exterior surface 18*a* and an interior surface 18*b*. Exterior surface 18*a* is gently curved, as shown in FIG. 3, to form a convex shape at the end of base 16. Interior surface 18*b* of head 18 is complementary to the top end 12*b* of grip 12. In particular, interior surface 18*b* is generally flat as is shown in FIGS. 2 and 6. When training aid 10 is engaged with grip 12, interior surface 18*b* of head 18 abuts top end 12*b* of grip 12. This engagement substantially prevents training aid 10 from sliding down the tapered grip 12 toward the club heel 30.

In accordance with yet another aspect of the present invention, a single arm 20 extends outwardly away from base 16 and more specifically from head 18 at second end 16*c* of base 16. In particular, arm 20 extends outwardly from a side region 18*e* of head 18 adjacent recess 38 of base 16. Arm 20 comprises a strut 44 and a knob 46. The end of strut 44 which is engaged with side region 18*c* originates a distance beneath the top surface 18*a* of head 18. Additionally, as seen in FIG.

7, the end of strut 44 which extends from side region 18*c*, originates at a location that is spaced a distance beneath the bottom surface 18*b* of head 18. Strut 44 preferably is disposed at an angle "A" (FIG. 3) relative to lateral axis "X" and at an angle "B" relative to longitudinal axis "Y". Angle "A" preferably is from about 25° to about 35° and preferably is around 28°. Angle "B" is from about 70° to about 80°, and preferably is approximately 75°. Additionally, FIG. 8 shows two axes "C" and "D" which intersect at a center point which is disposed along longitudinal axis "Y". Strut 44 is disposed at an angle "E" relative to axis "D". Angle "E" is from about 25° to about 35° relative to axis "D", and preferably is around 28° relative thereto. Thus, strut 44 is not disposed at right angles relative to the longitudinal axis "Y" of base 16 but instead extends downwardly and forwardly away from side region 18*c* of head 18 and off-center relative to base 16.

Figure 9:
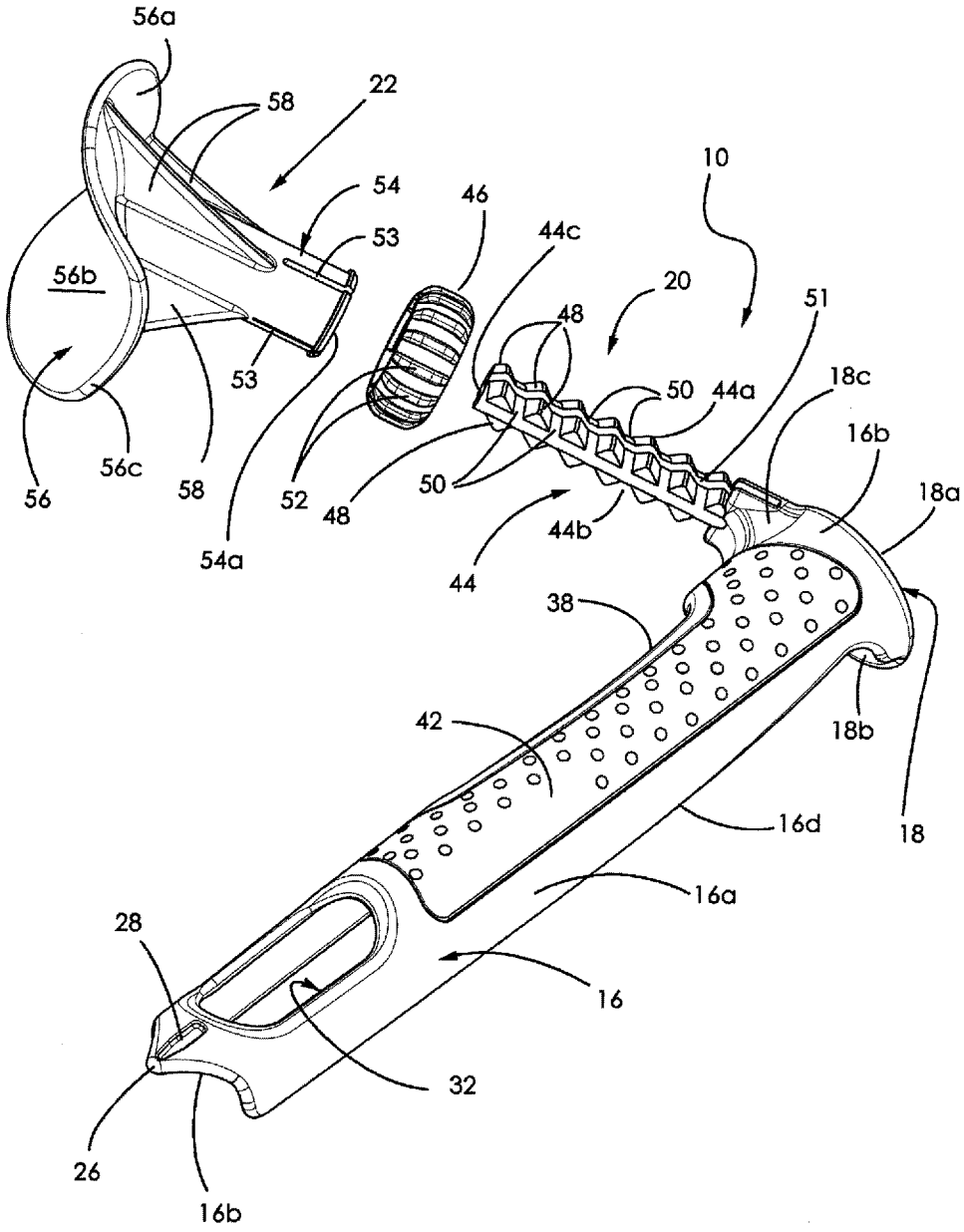
FIG. 9 is an exploded perspective view thereof.
Figure 9A:
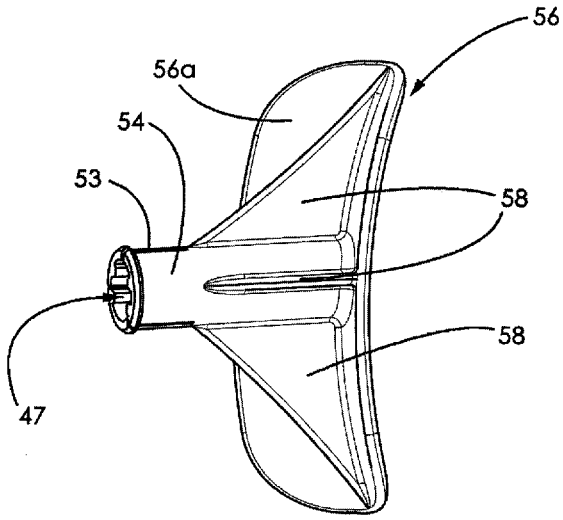
FIG. 9*a* is a perspective view of the support shown alone.
Figure 9B:
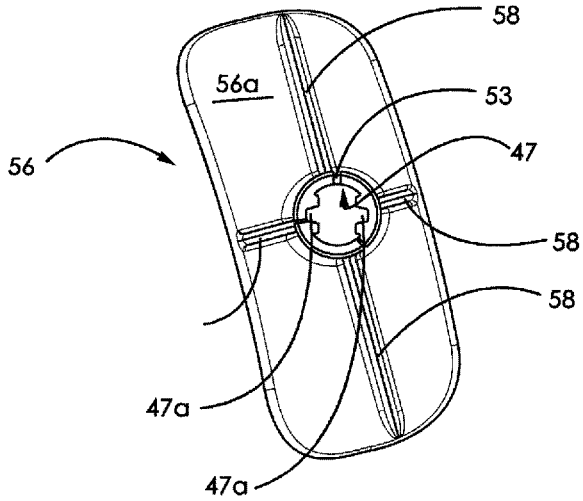
FIG. 9*b* is a rear view of the support shown from the end thereof which engages the strut.

FIG. 9 shows strut 44 has an upper surface 44*a* and *a* lower surface 44*b*. Strut 44 is threaded. Specifically, strut includes a plurality of alternating ridges 48 and valleys 50 which are provided on one or both of the upper and lower surfaces 44*a*, 44*b* thereof. Strut 44 further includes one or more grooves 51 which run from proximate side region 18*c* to free end 44*c* of strut 44. The free end 44*c* of strut 44 is configured to be complementary in shape to bore 47 of support 56. The configuration of bore 47 is shown in FIG. 9*b*. End 44*c* of strut 44 is inserted into bore 47 in the direction indicated by the arrow shown in FIG. 9*a*. The configuration of strut 44 and the wall of shaft 54 that defines bore 47 ensures that strut 44 is received into shaft 54 in a specific orientation.

Knob 46 is configured to engage strut 44 and to be rotatable about an axis aligned along strut 44. When knob 46 is rotated in a first direction, it is moved outwardly away from side region 18*c* of head 18. When knob 46 is rotated in a second direction it is moved inwardly toward side region 18*c* of head 18. Thus, as knob 46 is rotated the effective length of strut 44 is changed, as will be hereinafter described. Knob 46 is provided with knurling 52 on its exterior surface to make it easier for the golfer to grip and rotate the knob 46.

In accordance with yet another aspect of the present invention, support 22 is engaged with the free end 44*c* (FIG. 9) of strut 44. Support 22 comprises a shaft 54 and a support pad 56. Shaft 54 engages arm 20 and support pad 56 engages the golfer's wrist or forearm, as will be hereinafter described. Shaft 54 is generally circular in cross-sectional shape proximate a first end 54*a* thereof. Although not illustrated herein, it will be understood that first end 54*a* defines a recess therein and into which free end 44*c* of strut 44 is received after passing through a bore 47 (FIG. 4) of knob 46. Shaft 54 includes one or more slots 53 (FIG. 3) which extend into bore 47 and enable that end of shaft 54 to expand slightly when ridges 48 pass through the open end of shaft 54. The edges of strut 44 form blades which are configured to be received within depressions 47*a* (FIG. 9*b*) defined within an interior surface of shaft 54 defining bore 47. The engagement of the blades or edges of strut 44 within the two opposed depressions 47*a* maintains the alignment of support 22 on strut 44 during use.

Figure 10:
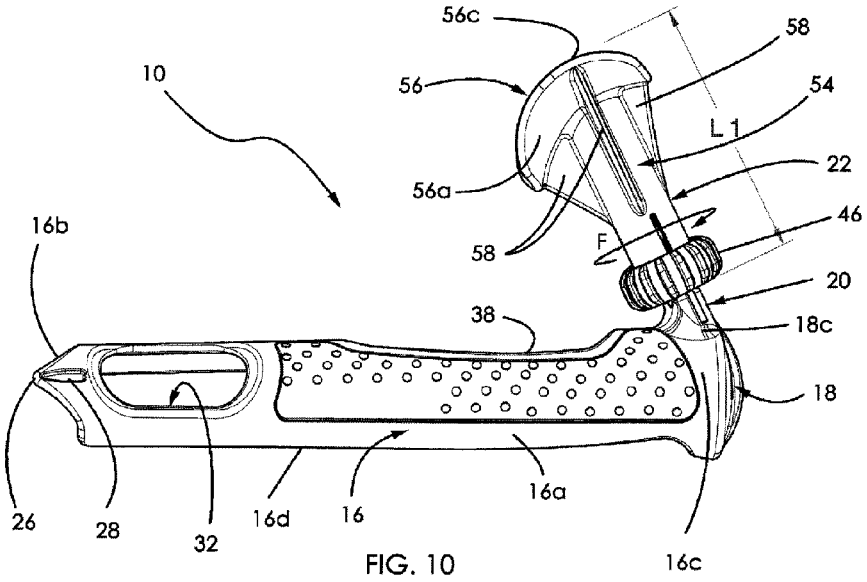
FIG. 10 is a front elevational view of the training aid with the support in a retracted position.
Figure 11:
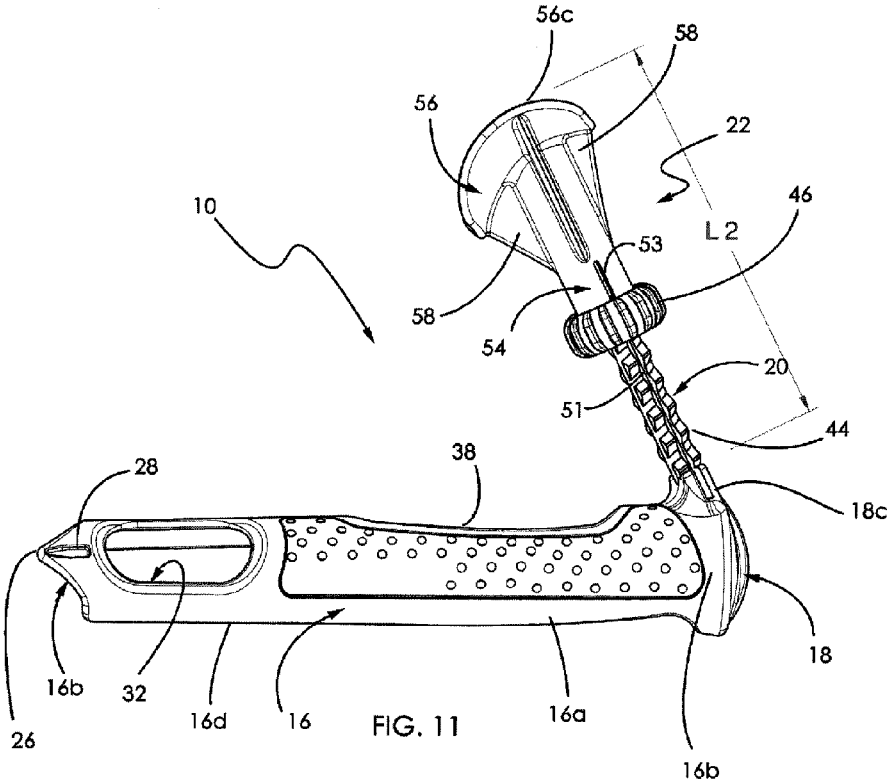
FIG. 11 is a front elevational view of the training aid with the support in an extended position.
Figure 12:
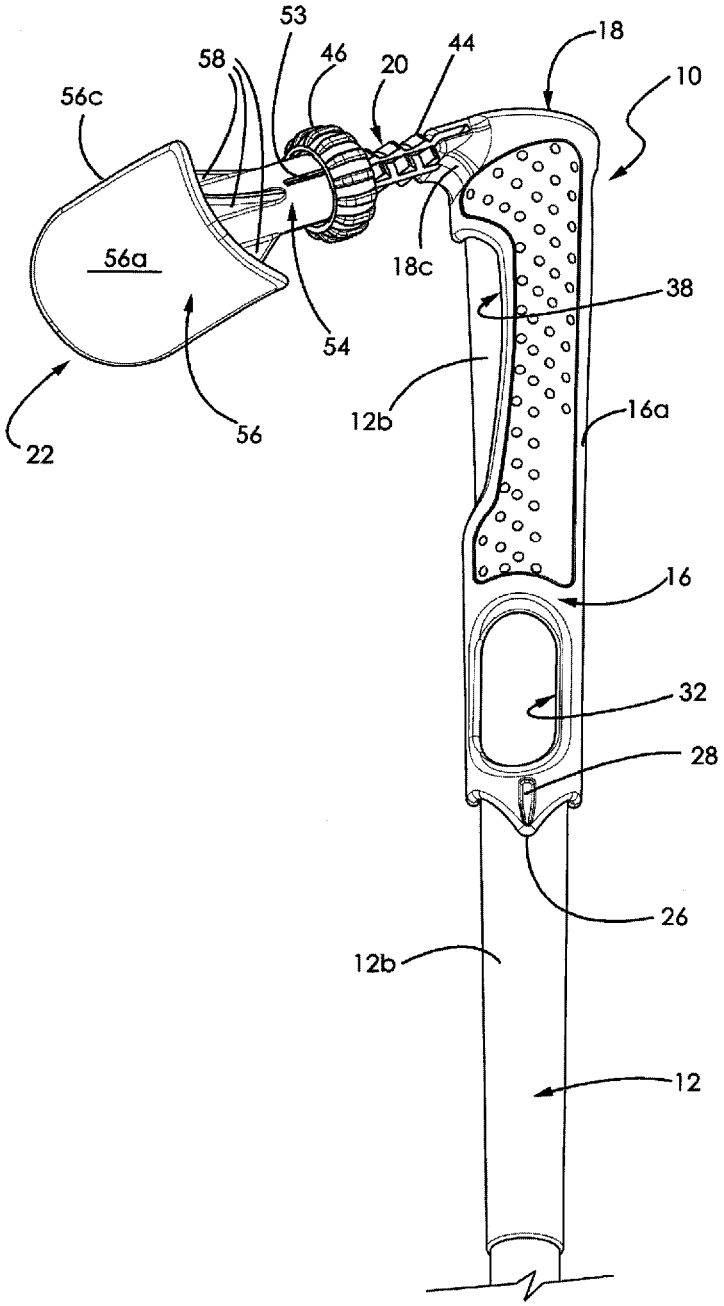
FIG. 12 is a front elevational view of the training aid mounted at the grip end of a golf club.

FIG. 10 shows a first instance where substantially the entire length of strut 44 is received within the recess of shaft 54. Knob 46 is disposed adjacent first end 54*a* of shaft 54 and adjacent side region 18*c* of head 18. The support pad 56 is disposed a distance "L1" away from the edge of side region 18*c*. FIG. 11 shows a second situation where substantially the entire length of strut 44 extends outwardly from shaft 54. Knob 46 is disposed adjacent first end 54*a* of shaft 54 and is disposed a distance away from the edge of side region 18*c*. Support pad 56 is disposed a distance "L2" away from the edge of side region 18*c*. Distance "L2" is greater than the distance "L1". In order to move support 22 from the retracted position, shown in FIG. 10, to the extended position, shown in FIG. 11, knob 46 is rotated in the first direction indicated by arrow "F" in FIG. 10. In order to move support 22 from the extended position to the retracted position, knob 46 is rotated in a second direction opposite from that indicated by arrow "F" in FIG. 10. As will be evident to those of ordinary skill in the art, support 22 may be moved to a partially extended position that is intermediate the positions shown in FIGS. 8 and 9 by rotating knob 46 in the appropriate one of the first and second directions until the desired distance between support pad 56 and the edge of side region 18*c* is attained. The golfer will make this adjustment to position support pad 56 at the appropriate position for his arm, as will be discussed further herein.

In accordance with yet another aspect of the present invention, support pad 56 is disposed generally a right angles to shaft 54. A plurality of bracing members 58 extend outwardly from the exterior surface of shaft 54 to a rear surface 56*a* of support pad 56. Bracing members 58 strengthen support pad 56 and ensure that support pad 56 does not flex when the golfer plays a stroke. Front surface 56*b* of support pad 56 is curved and contoured (FIG. 13) to be generally complementary to the interior surface of a person's wrist region or forearm. In particular, front surface 56*c* is curved in two directions to eliminate any sharp or angular edges from contacting the golfer's arm 66. This configuration ensures the correct anatomical position for the support 56 to be positioned squarely on arm 66. The peripheral edge 56*c* of support pad 56 is also gently rounded so as not to present any sharp edges which could potentially injure the golfer as they play a stroke using training aid 10.

Figure 13:
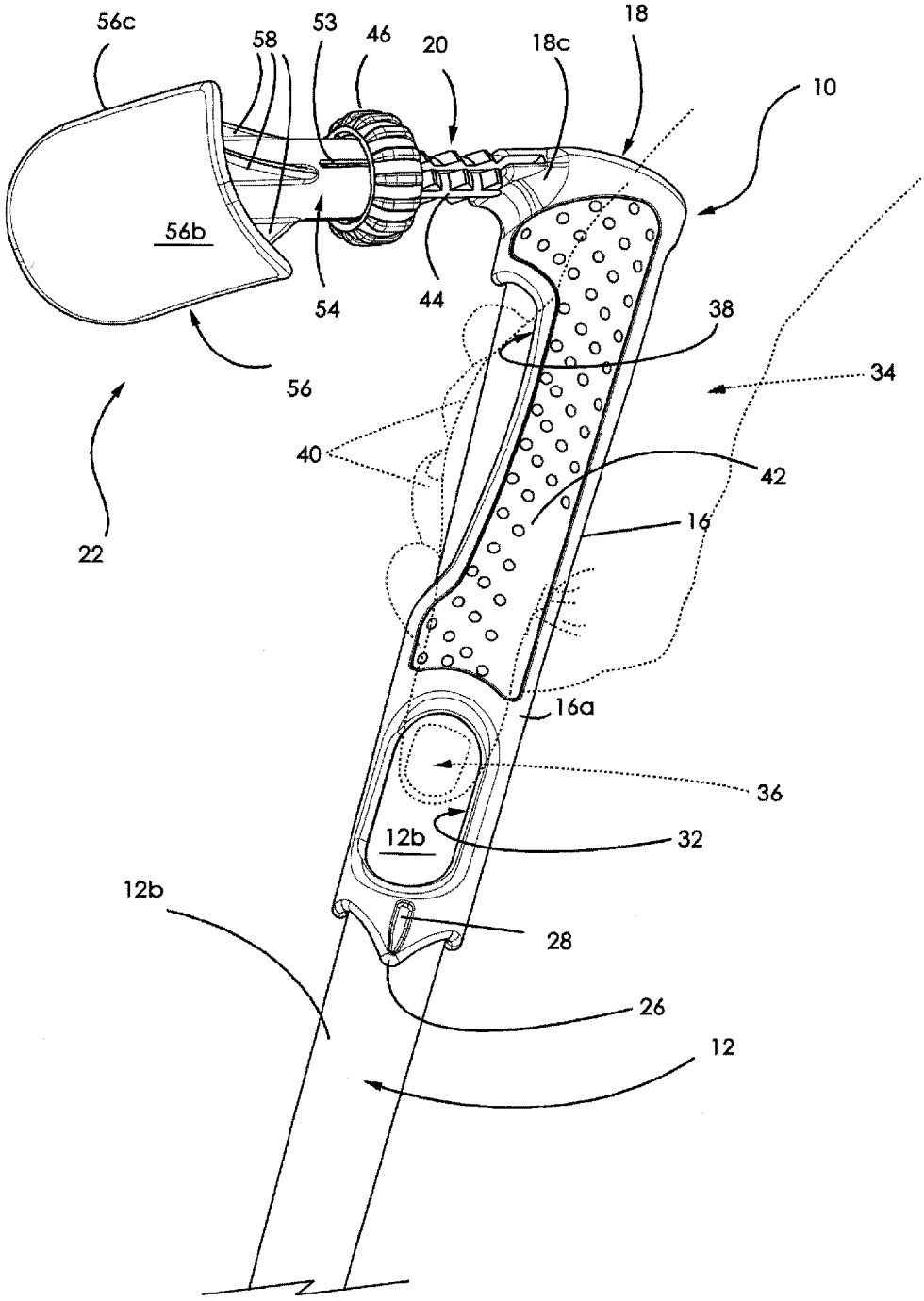
FIG. 13 is a front elevational view of the training aid mounted on the golf club grip and showing the placement of the golfer's upper hand on the training aid and grip.
Figure 14:
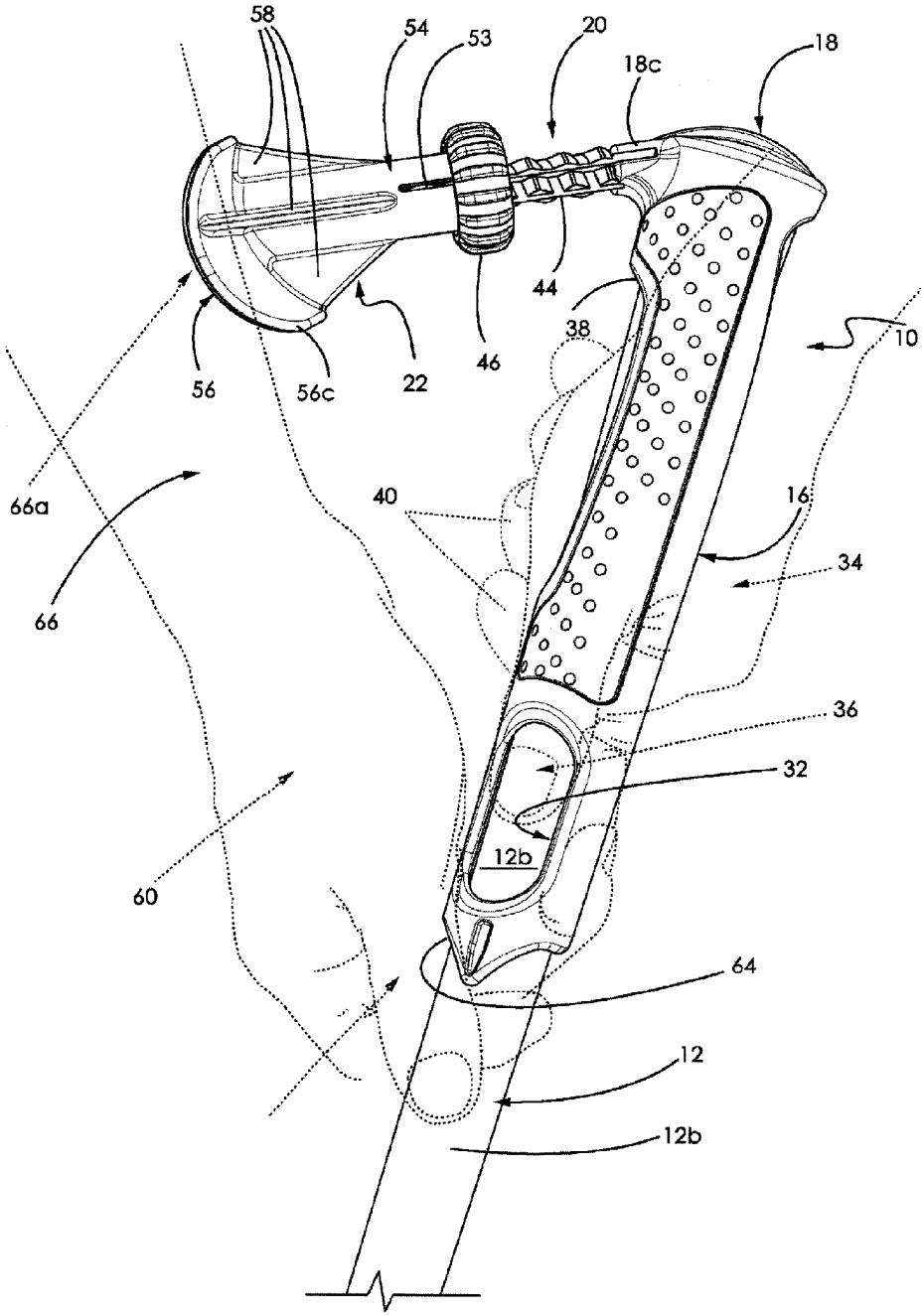
FIG. 14 is a front elevational view of the training aid mounted on the golf club grip and showing the placement of the golfer's upper and lower hands on the training aid and grip.

Training aid 10 is used in the following manner. Firstly, training aid 10 is engaged with grip 12 on club 14 by snap fitting base 16 around the exterior surface 12*a* thereof. Base 16 is then slid downwardly along grip 12 towards club heel 30 until interior surface 18*b* of head 18 is disposed in abutting contact with top end 12*b* of grip 12. Base 16 is rotated about grip 12 until apex 26 of base 16 and indicator 28 are substantially aligned with club heel 30 of club 14. The golfer will then grasp training aid 10 and grip 12 with his or her upper hand 34 by placing their thumb 36 in aperture 32 and wrapping their fingers 40 around grip 12 as shown in FIG. 13. The golfer then grasps club 14 with their lower hand 60 (FIG. 14) in such a way that their thumb 62 is disposed generally along an angled region 64 of base 16 and their fingers are wrapped around the lower regions of training aid 10 and grip 12. When lower hand 60 is in generally the correct position, the golfer will release the club 14 with his or her upper hand and will rotate knob 46 in one of a first and second direction to move support pad 56 into contact with the wrist or forearm region 66*a* of their arm 66. The golfer will then re-engage their upper hand 34 around training aid 10 and grip 12 and will play a practice stroke to determine if support pad 56 is placed in an appropriate location to substantially prevent their wrist 66*a* from breaking during the stroke. If the golfer determines that their wrist 66*a* is bending somewhat, then they will release the club again with their upper hand 34, and while maintaining their grip with the lower hand 60, they will rotate knob 46 in the appropriate direction to cause strut 44 to extend further outwardly from head 18. If the golfer determines that their wrist 66*a* is not bending but that the support pad 56 is digging uncomfortably into their arm, they will release the club again with the upper hand 34 and, while maintaining their grip with the lower hand 60, they will rotate the knob in the appropriate direction to cause the shaft to be somewhat retracted into shaft 54. The golfer will then take another practice stroke and will make the necessary adjustments until their wrist 66*a* is sufficiently supported by support pad 56 so that it is not breaking and so that the support pad 56 is comfortable on their arm 66 during play.

Training aid 10 is configured so that when the golfer is gripping it correctly and the support pad 56 is in the correct position on their wrist region 66*a*, the triangular shape between the golfer's shoulders and arms is maintained during play of a chip shot. Repeated use of training aid 10 aids in retraining the golfer's muscle memory to enable them to play chip shots more accurately and consistently.

When the golfer is finished practicing with training aid 10, the device is easily detached from club 14 by sliding base 16 upwardly away from club heel 30 until first end 16*a* thereof slips off top end 12*a* of grip 12. Knob 46 is then rotated to move support 22 into a retracted position for storage purposes.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A golf training aid comprising:

a base configured to grippingly engage a grip of a golf club, wherein the base has a top end, a bottom end and a wall extending therebetween, and wherein the wall has a first side edge and a second side edge which extend between the top and bottom ends of the base;

a head extending laterally outwardly from the top end of the base; wherein an inner surface of said head is adapted to be positioned adjacent an upper end of the grip;

a single arm extending outwardly from the wall of the base a first distance downwardly from the head; and wherein the single arm extends downwardly away from the wall at a constant angle from a first end of the arm to a second end thereof; and a support disposed at the second end of the arm, which support is adapted to contact a region of a golfer's wrist extending from a first hand which engages the bottom end of the base and the grip, and which support of substantially prevents the wrist of that first hand from breaking during play of a shot.

2. The training aid as defined in claim 1, wherein the angle is an angle other than 90°.

3. The training aid as defined in claim 2, wherein the base has a longitudinal axis extending between a first and second end thereof, and a lateral axis extending at right angles to the longitudinal axis, and wherein the angle of the arm is from about 25° to about 35° relative to the lateral axis.

4. The training aid as defined in claim 3, wherein the angle is around 28°.

5. The training aid as defined in claim 2, wherein the base has a longitudinal axis extending between a first and second end thereof, and wherein the arm extends outwardly from proximate the top end of the base at an angle of about 75° relative to the longitudinal axis of the base.

6. The training aid as defined in claim 1, wherein the arm is adjustable in length.

7. The training aid as defined in claim 6, wherein the support includes a shaft with a support pad disposed at a first end thereof, and the shaft defines a bore in a second end thereof; and wherein the arm includes a strut that is adjustably removable in the bore of the shaft; and the arm further includes a knob rotatable about the strut, and wherein rotation of the knob in a first direction increases an effective length of the strut, where the length is defined as a distance between the base and the second end of the shaft; and rotation of the knob in a second direction decreases the effective length of the strut.

8. The training aid as defined in claim 7, further comprising one or more depressions defined in an interior wall of the shaft; and one or more blades provided on at least one edge of the strut, and wherein the blades are configured to engage in the one or more depressions.

9. The training aid as defined in claim 7, wherein the strut is threaded.

10. The training aid as defined in claim 1, wherein bottom end of the base includes an indicator that is adapted to be aligned with a heel of the club.

11. The training aid as defined in claim 10; wherein the indicator comprises an aperture formed in the wall of the base.

12. The training aid as defined in claim 11, wherein the base has a longitudinal axis extending between the first end and a second end thereof; and wherein the aperture is disposed generally parallel to the longitudinal axis.

13. The training aid as defined in claim 10, wherein the first end of the base is substantially V-shaped and the apex of the V-shaped first end comprises the indicator.

14. The training aid as defined in claim 1, further comprising a first placement member provided on the wall of the base and positioned a second distance downwardly from the head; said first placement member being adapted to indicate to the golfer where to place one or more digits of the golfer's second hand on the training aid, which second hand is positioned proximate the top end of the base.

15. The training aid as defined in claim 14, wherein the single arm extends outwardly from the wall proximate the first side edge thereof and between the head and the first placement member.

16. The training aid as defined in claim 14, wherein the first placement member comprises a recess defined in the first side edge of the wall.

17. The training aid as defined in claim 14; further comprising a second placement member provided on the wall in a position between the bottom end of the base and the first placement member; said second placement member being adapted to position a part of the golfer's first hand on the training aid proximate the bottom end of the base.

18. The training aid as defined in claim 17, wherein the second placement member comprises an aperture defined in the wall of the base.

19. The training aid as defined in claim 1, wherein base is C-shaped in cross-section and is configured to snap-fittingly engage the grip of the club.

20. A method of practicing golfing chip shots comprising the steps of:

positioning a chip-shot training aid on the grip of a golf club;

aligning an indicator on the aid with a heel of the club;

positioning a golfer's second hand on the training aid and wrapping fingers of the second hand around a top end of the training aid and the grip;

holding the club with the second hand;

placing the golfer's first hand on the training aid and grip proximate a bottom end of the training aid;

releasing the grip with the second hand; and adjusting a support arm extending outwardly from the training aid so as to position a support pad disposed on the support arm against the golfer's wrist extending from their first hand;

repositioning the second hand on the training aid and grip; and playing the chip shot.

21. The method as defined in claim 20, wherein the support arm has a length and the method further comprises the step of adjusting the support arm's length to cause the support pad thereon to be disposed adjacent the golfer's wrist.

22. The method as defined in claim 21, wherein the step of adjusting the support arm's length includes the steps of:

rotating a knob on a strut that is received in a bore defined in a second end of the support arm in a first direction to increase an effective length of the strut, where the length is measured between the base and the second end of the support arm; and rotating the knob in a second direction to decrease the effective length of the strut.

23. The method as defined in claim 22, further comprising the step of engaging one or more blades on at least one edge of the strut in depressions defined in an interior wall of support pad which defines the bore.

24. The method as defined in claim 20, wherein the step of aligning the indicator on the training aid with the heel of the club includes the step of:

aligning an apex of a V-shaped first end of a base of the training aid with the heel of the club.

25. The method as defined in claim 24, further comprising the step of rotating the base of the training aid around the grip of the club in either of a first and a second direction to cause the apex of the V-shaped first end of the base to align with the heel of the club.

26. The method as defined in claim 20, wherein the step of aligning the indicator on the training aid with the heel of the club includes the step of:

aligning an aperture which extends parallel to a longitudinal axis of the base with the heel of the club.

* * * * *

UNITED STATES PATENT AND TRADEMARK OFFICE

CERTIFICATE OF CORRECTION

PATENT NO. : 8,864,600 B2
APPLICATION NO. : 14/042925
DATED : October 21, 2014
INVENTOR(S) : Robert G. Dickie It is certified that error appears in the above-identified patent and that said Letters Patent is hereby corrected as shown below:

In the Claims

Column 8, line 16 (Claim 10) “wherein bottom” should be changed to --wherein the bottom--.

Signed and Sealed this
Third Day of March, 2015

Michelle K. Lee

Michelle K. Lee
*Deputy Director of the United States Patent and Trademark Office*